US009583081B2

(12) United States Patent
Broadbelt

(10) Patent No.: US 9,583,081 B2
(45) Date of Patent: Feb. 28, 2017

(54) PERCUSSION DEVICE

(71) Applicant: One Beat Better, LLC, Malvern, PA (US)

(72) Inventor: Jeffrey S. Broadbelt, Malvern, PA (US)

(73) Assignee: One Beat Better, LLC, Malvern, PA (US)

( * ) Notice: Subject to any disclaimer, the term of this patent is extended or adjusted under 35 U.S.C. 154(b) by 0 days.

(21) Appl. No.: 14/742,582

(22) Filed: Jun. 17, 2015

(65) Prior Publication Data

US 2016/0372092 A1 Dec. 22, 2016

(51) Int. Cl.
*G10D 13/02* (2006.01)

(52) U.S. Cl.
CPC ..... *G10D 13/02* (2013.01)

(58) Field of Classification Search
CPC .... G10D 13/02; G10D 13/021; G10D 13/028; G10D 13/023; G10D 13/027; G10D 13/024; G10D 13/026; G10D 13/00; Y10T 29/49; G10G 5/00; G10H 3/146; G10H 2230/275; F16M 11/14; F16M 11/2092; F16M 11/02
USPC ..... 84/411 R, 411 P
See application file for complete search history.

(56) References Cited

U.S. PATENT DOCUMENTS 1,346,588 A 7/1920 Bower
2,326,305 A 8/1943 Morarre
2,475,873 A 7/1949 Banta
2,495,495 A 1/1950 Adler
3,113,480 A 12/1963 Giarratano
3,186,290 A 6/1965 Gould et al.
3,261,253 A 7/1966 Ulano
4,168,064 A 9/1979 Petrovic
4,173,917 A 11/1979 Della-Porta
4,179,974 A 12/1979 Trankle
4,779,507 A 10/1988 Shimoda et al.
D298,951 S 12/1988 Benson et al.
D442,985 S 5/2001 Liao
6,362,407 B1 3/2002 Dennis et al.
6,518,490 B2 * 2/2003 Good ..... G10D 13/027 84/411 R
7,429,698 B2 9/2008 Pickens
7,723,593 B1 5/2010 Prentice et al.
7,985,908 B1 7/2011 Howard et al.
8,253,001 B1 * 8/2012 Liu ..... G10D 13/02 84/411 R (Continued)

OTHER PUBLICATIONS

"Prentice Practice Pads"; http://www.jazzedmagazine.com/4070/articles/gearcheck/gearcheck-september-2014/; pp. 5/16 and 6/16; as of Aug. 4, 2015; prenticepracticepads.com.

(Continued)

*Primary Examiner* — Kimberly Lockett
(74) *Attorney, Agent, or Firm* — Stephen G. Stanton

(57) ABSTRACT

A percussion device includes (1) a platform portion composed of a first material having an exposed striking portion composed of a second material different from the first material; (2) a base portion separated from, and substantially parallel to, the platform portion by a predetermined distance; and (3) at least one unitary sidewall portion positioned between the platform portion and the base portion at respective opposing edges of the platform portion and the base portion.

19 Claims, 11 Drawing Sheets

(56) References Cited

U.S. PATENT DOCUMENTS

| | | | |
|---|---|---|---|
| 8,829,319 | B2 | 9/2014 | Martinazzi |
| 8,853,514 | B2 | 10/2014 | Cox, Jr. |
| 2014/0238216 | A1 | 8/2014 | Mino |

OTHER PUBLICATIONS

"Ahead Chavez S-Hoop Marching Practice Pad with Snare Sound"; http://www.musiciansfriend.com/drums-percussion/ahead-chavez-s-hoop-marching-practice-pad-with-snare-sound#productDetail; as of Aug. 4, 2015.

"Rampad 10 Orchestral Practice Pad"; http://www.lonestarpercussion.com/Practice-Classroom/Snare-Practice-Pads/Rampad-10-Inches-Original-Practice-Pad-RP-OR—001-.html; (http://www.lonestarpercussion.com/Practice-Classroom/Practice-Pads/Snare-Practice-Pads/#/~search/page/1/view/listView) as of Aug. 4, 2015; www.lonestarpercussion.com.

"Prentice Practice Pads"; http://www.prenticepracticepads.com/flash.html; as of Aug. 4, 2015.

"Instrumentation: 4 Timbrepads"; http://michaeludow.com/wp-content/uploads/2014/01/Timbrack-Quartet-Score-2.pdf; as of Aug. 4, 2015.

* cited by examiner

PERCUSSION DEVICE

FIELD OF THE INVENTION

The present invention relates to drum percussion devices, and more specifically to improved drum percussion devices suitable for practice and for performance.

BACKGROUND OF THE INVENTION

The practice of percussion drumming has traditionally used practice drum pads having a resilient upper striking surface of a body that is designed to muffle or reduce the noise levels otherwise accompanying the use of a percussion drum. Such reduction in noise levels protects a user's hearing, as well as the hearing of any nearby persons, and attempts to minimize the otherwise loud sound of a traditional drum. The resilient upper striking surface is designed to mimic the striking head of a traditional drum so that such practice on the drum pad mimics playing on a traditional drum. Practice drum pads are also just that, limited to practice playing a drum(s).

Some examples of practice drum pads include the reversible practice pad for drum practice disclosed in U.S. Pat. No. 7,723,593 to Prentice et al. (hereinafter "Prentice"). In Prentice, the reversible pad includes a planar base having at least one sloping base-riser projecting upwardly, and a planar platform having at least one sloping platform-riser projecting downwardly. Each exposed surface of the base-riser and the platform-riser has either one of a two-part fastening material designed to reversible mate when joined together. For example the top surface of the base-riser may have the first part of the fastening material and the bottom surface of the platform-riser may have the second part of the fastening material. The base-riser and platform-riser are designed such that when joined in a first position the planar platform is parallel to the planar base, and when joined in a second position, the planar platform is angled relative to the planar base, and to the surface upon which the planar base is positioned. Such angling of the planar platform mimics the angle of, for example, a snare drumhead as played normally, and when the planar platform is in the first position and not so angled, it mimics, for example, a floor tom-tom.

An older example of such a practice pad is disclosed in U.S. Pat. No. 1,346,588 to H. A. Bower (hereinafter "Bower"). The Bower discloses a drum practice pad having a layer of sound insulating material between an upper lower base of rather dense or hard wood having apertures therein to receive lacing ribbon to bind the base and sound insulating material layer to an upper sounding board (formed of a stiff but flexible material such as, for example, gutta percha, whalebone, paper mache, or fiberboard) covered in felt.

U.S. Pat. No. 2,495,495 to Adler (hereafter "Adler") discloses a drum practice pad having: (1) a box-like structure with a thick rectangular base 10; (2) front and back side walls 11, 12 mounted on the base 10; with (3) an open-ended resonant sound chamber; (4) a resilient practice pad 20 of rubber, for example; over (5) a central thin percussion portion 18. Opposing thick wooden doors 21 for the ends of the box are each hinged at their lower edges and are connected to means for adjusting the doors 21. During use, adjustably opening and closing the doors 21 control the sound volume.

U.S. Pat. No. 3,186,290 to Gould et al. (hereafter "Gould") discloses a drum practice device that is a rectangular box-like configuration including: (1) an upper, rigid, frame member having: (1) a central opening; (2) a base of similar material as the upper frame member; (3) joined by side walls enclosing a shock absorbing chamber beneath the opening; (4) a cushioning material is inserted to a non-compressed height flush with surface of frame; (5) air release apertures extend through the base to the chamber; and (6) a flexible energy transmitting pad formed of a rubber sheet material overlies central opening. In one embodiment, a Gould device may be inclined.

U.S. Pat. No. 6,362,407 to Dennis et al. (hereinafter "Dennis") discloses a drum practice pad comprised of a flat circular piece of hard material having a flat circular piece of resilient material bonded to the upper surface. The flat circular piece of resilient material may have a diameter less than the diameter of the circular piece of hard material. One embodiment is to a drum practice pad for use on a table top or the like, and includes three modified circular cushions spaced from the center of the hard material by a distance equal to two-thirds the radius of the hard material. Various mounting structures are also disclosed.

U.S. Pat. No. 8,829,319 to Martinazzi (hereinafter "Martinazzi") discloses a percussion instrument comprising a batter and a resonant drum both including a ring base, a lateral wall that stands on it, with each drum spaced from each other and facing with their bases to define a lateral opening for the air set in vibration by two members. Martinazzi also discloses a schematic of the modulation of the sound waves in the percussion instrument.

However, conventional practice drum pads have several drawbacks and are suited for practice, and are not suited for practice and performances.

SUMMARY OF THE INVENTION

The present invention seeks to provide an improved percussion device that may also be used in practices as well as in performances.

In one embodiment of the present invention, a percussion device includes: (1) a platform portion composed of a first material having an exposed striking portion composed of a second material different from the first material; (2) a base portion separated from, and substantially parallel to, the platform portion by a predetermined distance; and at least one sidewall portion positioned between the platform portion and the base portion at respective opposing edges of the platform portion and the base portion.

BRIEF DESCRIPTION OF THE DRAWINGS

The present invention will be more clearly understood from the following description taken in conjunction with the accompanying drawings in which like reference numerals designate similar or corresponding elements, regions and portions and in which.

DETAILED DESCRIPTION OF THE PREFERRED EMBODIMENT

It is understood that the accompanying drawings do not necessarily illustrate each and every detail of the construction or use of the present invention as one of ordinary skill in the art would understand. The term "about" when referring to a numerical range or value is a convenience and is to be interpreted as plus or minus 10% of that value or range. For example "from about 100 to 1000" is to be interpreted as within the range of 90 to 1100 and "about 1000" is to be interpreted as within the range of 900 to 1100. Dimensions provided for exemplary embodiments are only exemplary, and differing dimensions are contemplated for each exemplary embodiment.

Figure 1A:
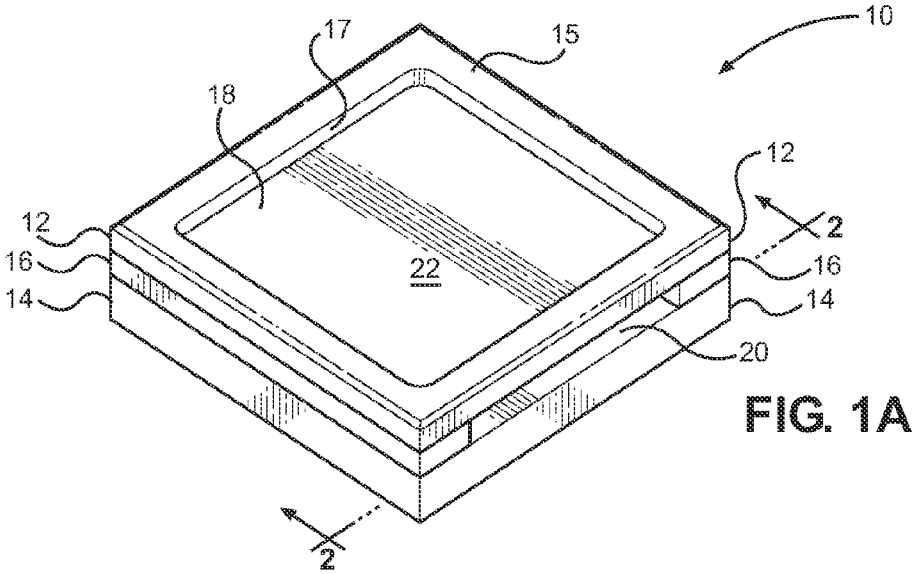
FIG. 1A is a perspective top view of a percussion device made in accordance with an exemplary embodiment of the present invention.
Figure 1B:
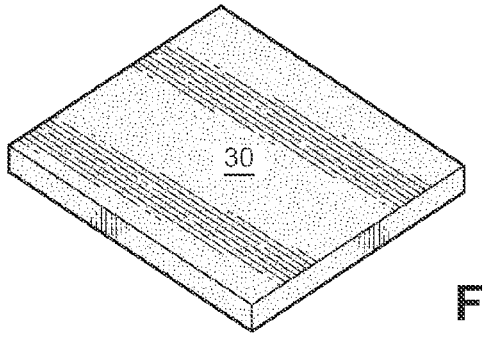
FIG. 1B is a perspective top view of an insert portion in use made in accordance with an exemplary embodiment of the present invention.
Figure 1C:
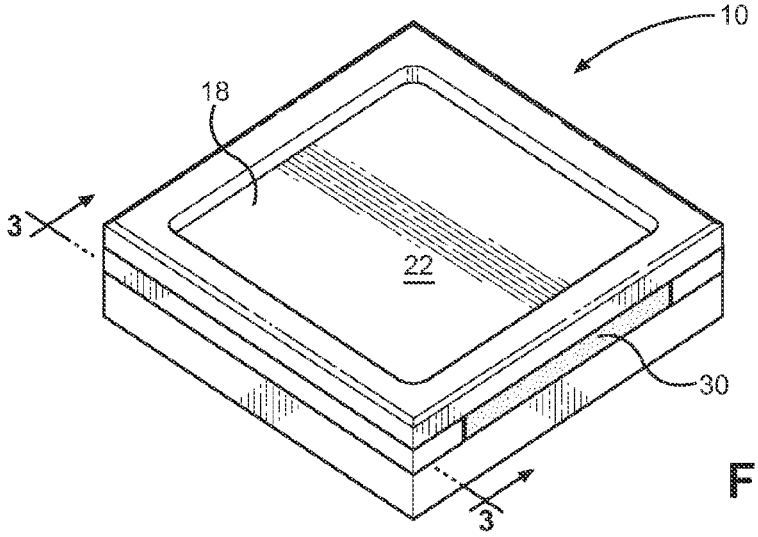
FIG. 1C is a perspective top view of an insert portion positioned within a cavity of the percussion device made in accordance with an exemplary embodiment of the present invention.

FIGS. 1A-1C illustrates rectangular percussion device/pad 10 (e.g., drum pad 10) of the present invention. Percussion device 10 includes upper platform portion 12 and lower base portion 14 separated by at least one sidewall portion, or two opposition sidewall portions 16 (as illustrated), and defining cavity (or chamber) 20 there through (e.g., also see FIG. 2). Cavity 20 may be a resonating cavity. One or more of platform portion 12, base portion 14 and sidewall portions 16 may be comprised of wood, hard plastic, etc. They may all be comprised of the same material, or of differing materials as desired. For example, platform 12, base 14 and sidewall portions 16 may be comprised of poplar wood, maple wood, oak wood, hickory wood, rosewood, etc. or a combination of such woods. It is noted that poplar wood drum pads have a lower pitch than maple wood drum pads of roughly the same size, since poplar wood is less dense than maple wood. Drum pad 10 may be one piece, or unitary, or platform portion 12, base portion 14 and sidewall portions 16 may be separate pieces held together by, for example, fasteners, binders, adhesives, wood elements, or a combination thereof. For example, a dowel joint wood element may join together separate portions 12, 14, 16 with use of a binder or adhesive. The upper surface 15 of platform portion 12 includes striking portion 18.

FIG. 1B illustrates insert portion (muffler pad) 30 that may be sized to removeable fit within cavity 20. Insert 30 may be composed of open or closed cell foam material, dense rubber, soft rubber, etc., and serves to muffle the pitch and sound of a drum strike when placed within cavity 20. FIG. 1C illustrates muffler pad 30 placed within cavity 20 of drum pad 10. Muffler pad 30 may be configured to be easily inserted, and retained within, cavity 20 during use of drum pad 10, and easily removed from cavity 20 as desired.

Figure 2:
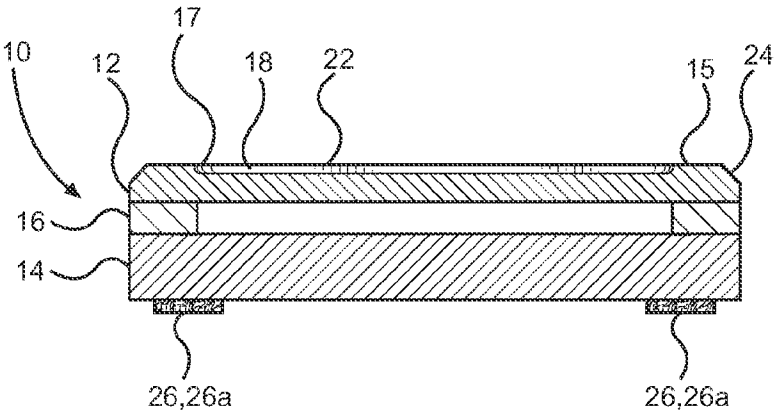
FIG. 2 is a side, cut-away view of the percussion device of FIG. 1A taken along line 2-2 of FIG. 1 and made in accordance with an exemplary embodiment of the present invention.

As may be more clearly illustrated in FIG. 2, striking portion 18 is on the upper surface of platform 12, and may be placed within a recessed portion 17 within the upper surface of platform 12. For example, if drum pad 10 is comprised of wood, a router may be used to form from an about 3/32 inch to 1/8 inch essentially centered, deep rout out in the upper surface of platform portion 12. The rout out has a width and length so that striking portion 18 fits there within, and may be retained there using, for example, a binder or adhesive such as appropriate glue. Exposed surface 22 of striking portion may be flush with (as illustrated in FIG. 2), extend above, or be recessed below (e.g., see FIG. 6C), the non-routed surface of platform portion 12 as desired. Striking portion 18 may be composed of a resilient material that imitates the playing surface, and provides a similar rebound, as that of a conventional drumhead. For example striking portion 18 may be composed of natural gum rubber, a synthetic rubber, silicone, etc., such that when struck with a drum stick or the like, the drum stick bounces as it would when striking a head of a conventional drum. It is noted that differing conventional drums have differing bounce characteristics, for example, a tight head of a snare drum vs. a head of a floor tom-tom drum, etc., and striking portion 18 may vary accordingly. Striking portion 18 may have a thickness of about, for example, 1/8-1/4 inch, such that the thickness of striking portion 18 may relate to the depth of the rout out within the upper surface of platform portion 12.

FIG. 2 (taken along line 2-2 illustrated in FIG. 1A) also illustrates that cavity/chamber 20 may extend completely through drum pad 10. When striking surface 22 of striking portion 18 is struck with, for example, a drumstick, the presence of cavity/chamber 20 assists in achieving a certain pitch of the resulting sound (e.g., a drum strike). For example, the denser the material/wood from which portions 12, 14, 16 are made, the higher the pitch of the resulting sound may be (as compared to portions 12, 14, 16 having less dense wood). Generally, the larger the cavity/chamber 20, the lower the pitch, and the smaller cavity/chamber 20, the higher the pitch. Chamber size, thickness of material comprising drum pad 10, type/density of material comprising drum pad 10, the thickness of the upper platform material directly beneath striking portion 18, and the thickness and size of striking portion 18 are all factors in establishing the sound/pitch of drum pad 10 when struck/played. Striking portion 18 may be sized and positioned to be completely over chamber/cavity 20. Platform portion 12 also may include beveled edges 24. Beveled edges 24 provide an aesthetic appeal and also eliminate harsh edges during handling and use of drum pad 10.

Figure 3:
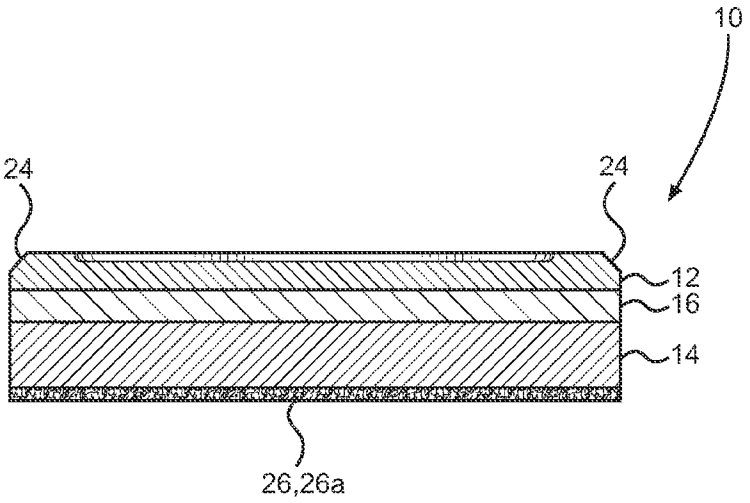
FIG. 3 is a side view of the percussion device of the percussion device of FIG. 1C taken along line 3-3 and made in accordance with an exemplary embodiment of the present invention.

FIG. 3 is a side view of drum pad 10 (taken along line 3-3 illustrated in FIG. 1C) and appears rotated 90 degrees clockwise as compared to FIG. 2. If exposed surface 22 of striking portion 18 is below, or flush with (as illustrated), routed portion 17, then striking portion 18 is not seen in FIG. 3 as upper surface 15 of platform portion 12 masks striking portion 19 from view.

Drum pad 10 illustrated in FIGS. 1-5 (with FIGS. 4-5 being a top plan view and a bottom plan view, respectively) is square-shaped (may be rectangular shaped in general) may have the following exemplary dimensions. Lower base portion 14 may be 7 3/16 inch square by 3/4 inch thick, upper platform 12 may also be 7 3/16 inch square by 5/16 inch thick, and sidewall portions 16 may be each 7 3/16 inch long, 25/32 inch wide with a thickness of about 7/16 inch. This results in cavity/chamber 20 being 7 3/16 inch long, 5 5/8 inch wide from sidewall portion 16 to sidewall portion 16, and having a height of about 7/16 inch.

Of course drum pads 10 formed in accordance with the teachings of the present invention may have different dimensions in order to construct drum pads 10 composed of the same materials to produce varying pitches when struck on striking portion 18. As noted above, constructing drum pads 10 out of varying materials having greater density may produce a higher pitch when stuck, and materials having lesser density may produce a lower pitch. For example drum pads 10 may be constructed to produce a B flat pitch when struck, with other drum pads 10 constructed to have pitches in thirds from B flat pitch to produce sets of drum pads 10 tuned within a predetermined pitch range. This is only an example, and drum pads 10 may be constructed to produce other pitches, and with other pitch ranges, as well. Generally, the smaller drum pad 10, the higher the pitch produced when played/practiced upon, and the larger drum pad 10, the lower the pitch produced when played/practiced upon (as noted above).

Figure 4:
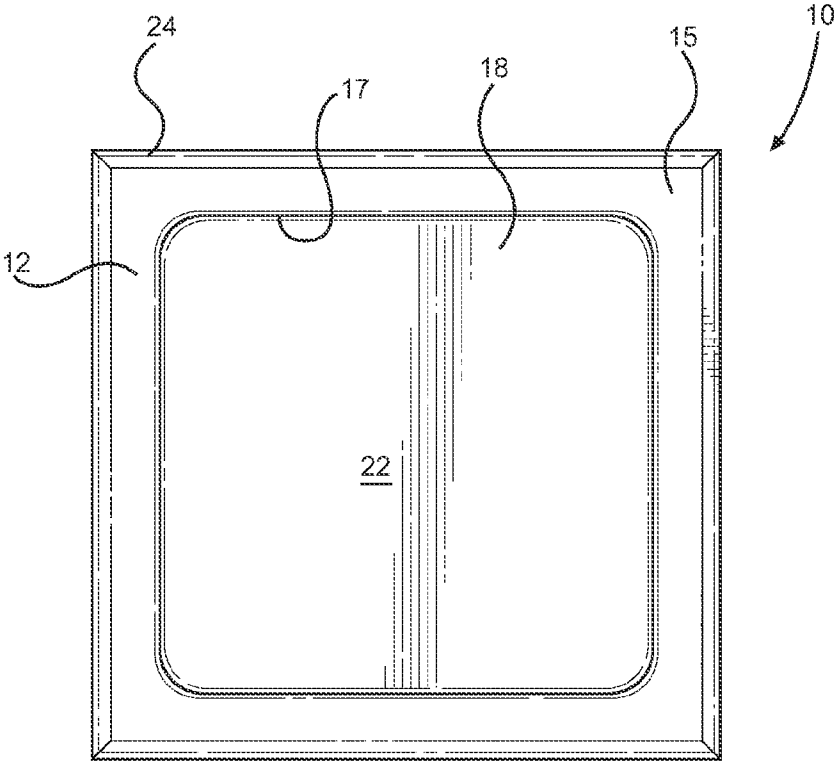
FIG. 4 is a top plan view of the percussion device of FIG. 1A made in accordance with an exemplary embodiment of the present invention.

FIG. 4 illustrates drum pad 10 in a top down, plan view of drum pad 10. Striking structure 18, with striking surface 22, may be positioned to overlay the chamber (not shown, but see, e.g., FIGS. 1A, 1C, and 2). A portion of upper surface 15 of platform 12 may extend around striking structure 18, and if striking surface 22 of striking structure 18 is recessed below the plane of the surrounding upper surface 15, that may make it easier for a so-called 'rim shot' where the surrounding upper surface 15 is intentionally struck by a drum stick.

Figure 5:
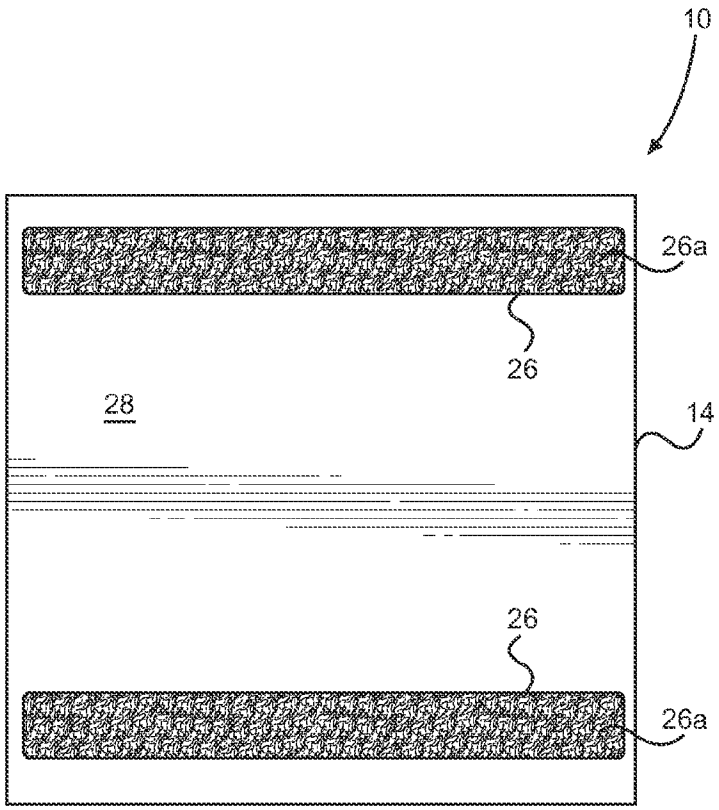
FIG. 5 is a bottom plan view of the percussion device of FIG. 1A made in accordance with an exemplary embodiment of the present invention.

As illustrated in FIG. 5, a bottom up, plan view of drum pad 10, strips 26 of material are affixed to bottom surface 28 of base portion 14 such that strips 26 parallel sidewall portions 16 and may be offset up to about 1/2 inch from the edge of base portion 14. Material strips 26 may be comprised of non-skid material to protect surfaces upon which drum pad 10 may be placed, or may be comprised of one of a hook-side and loop-side of a hook-and-loop material pair (as illustrated). In the case of a hook-and-loop material pair, when engaged, the exposed side of the hook-and-loop material pair may also be comprised of a non-skid material. For example, as illustrated in FIG. 5, material strip 26 may be loop-side strip 26*a* as will be useful to reversibly adhere drum pad 10 to a mounting structure having corresponding hook-side strips as will be described below. Material strip 26 may be about 7 inch long by 3/4 inch wide although other sizes of material strips 26, and numbers of material strips 26, are contemplated. A strip of opposing loop-and-hook material, for example strips of hook material having the same dimensions, for example about 7 inch long by about 3/4 inch (not shown), may be affixed to loop material strips 26 so that the non-skid surfaces of the hook materials are exposed so that drum pad 10 may be placed on a surface with the surface being protected, and so that drum pad 10 may tend to stay stationary when placed and played on such surface.

Figure 6A:
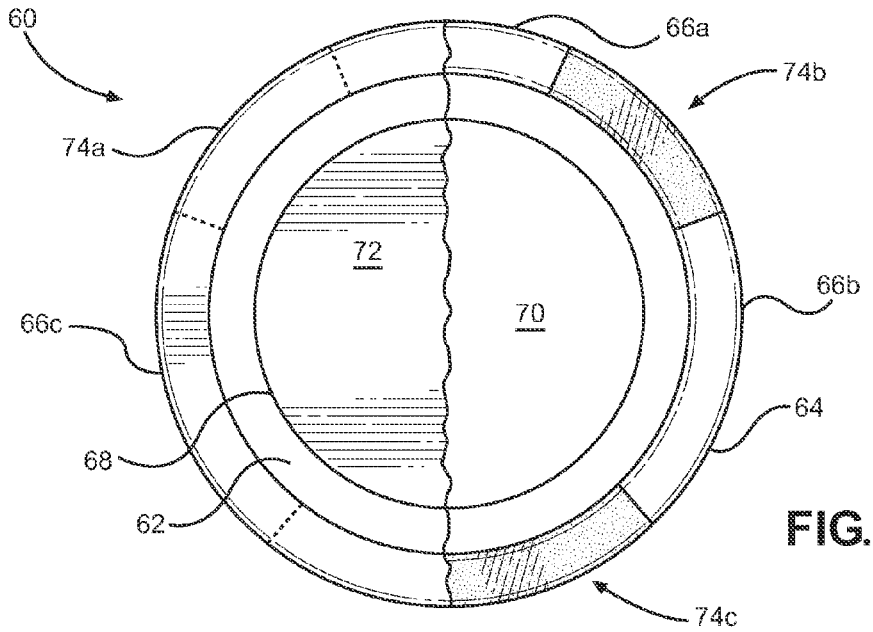
FIG. 6A is a top plan, partial cut-away view of a round percussion device made in accordance with an exemplary embodiment of the present invention.

FIG. 6A is a top plan, partial cut-away view, which illustrates an alternate drum pad 60 having a round shape in accordance with a preferred embodiment of the present invention. Round drum pad 60 includes round base portion 64 and round platform portion 62 separated by three curved sidewall portions 66 formed from, and integral with, platform portion 62, equally spaced around the periphery of base portion 64/platform portion 62 (but not equally sized).

For drum pad 60 comprised of wood, three sidewall portions 66*a*, 66*b*, 66*c* may be ripped from round platform portion 62 to form cavity openings 74*a*, 74*b*, 74*c*. Thus, sidewall portions 66 are thus integral with round platform portion 62. Three curved sidewall portions 66 of round platform portion 62, and base portion 64 define cavity openings 74*a*, 74*b*, 74*c*, that may be ripped from platform portion 62, accessing round cavity 70 (defined by base portion 64, platform portion 62 and sidewall portions 66). Cavity 70 may be a resonating cavity. Opening 74*c* may be about 1.6 times the size of each of openings 74*a*, 74*b*. For Example, an arc of opening 74*c* may be about 20% of the total circumference of round drum pad 60, while openings 74*a*, 74*b* are each 12.5% of such total circumference. Round drum pad may have an about 7 1/8 inch diameter, cavity 70 may have an about 5 7/8 inch diameter from the inner portion of sidewall portion 66 to the inner portion of roughly opposing sidewall portion 66 as illustrated. A portion of platform portion 62 may exist between striking portion 68 and the outer edge of platform portion 62. In one example such portion of striking portion may be about 5/8 inch wide. Round striking portion 68 may have a diameter of 5 7/8 inch, may be centered over platform portion 62 (and may be sized the same as cavity 70), and includes striking surface 72. As with square drum pad 10, striking portion 68 may have a thickness of that of square striking portion 18 and be placed within a 3/32-inch deep depression in the upper surface of platform portion 62. Such depression may be routed into the upper surface of platform portion 62. Striking portion 68 may be composed of a resilient material that imitates the playing surface, and provides a similar rebound, as that of a conventional drumhead. For example striking portion 68 may be composed of natural gum rubber, a synthetic rubber, silicone, etc. Striking portion 68 may have a thickness of about, for example, 1/8-1/4 inch, and such thickness relates to the depth of the rout out within the upper surface of platform portion 62. For example, round base portion 64 may have a thickness of about ¾ inch, round sidewalls portions 66 may have a thickness of about 7/16 inch and round platform portion 62 may have a thickness of about 5/16 inch.

Figure 6B:
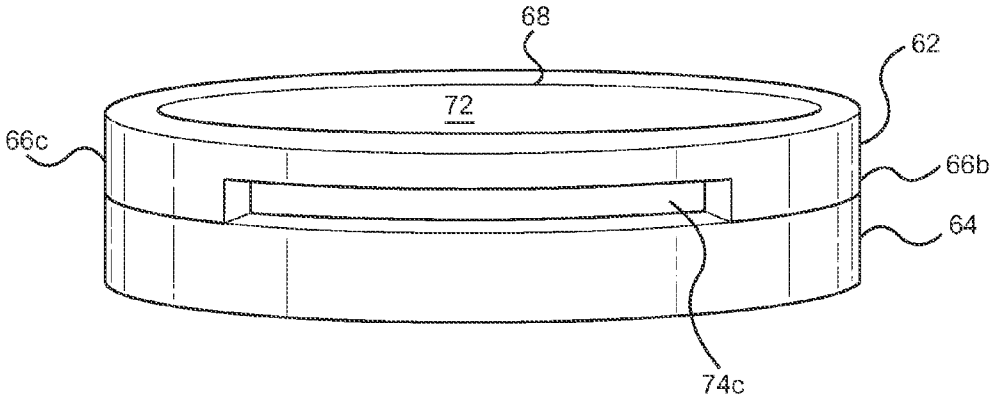
FIG. 6B is a perspective side view of the round percussion device of FIG. 6A.
Figure 6C:
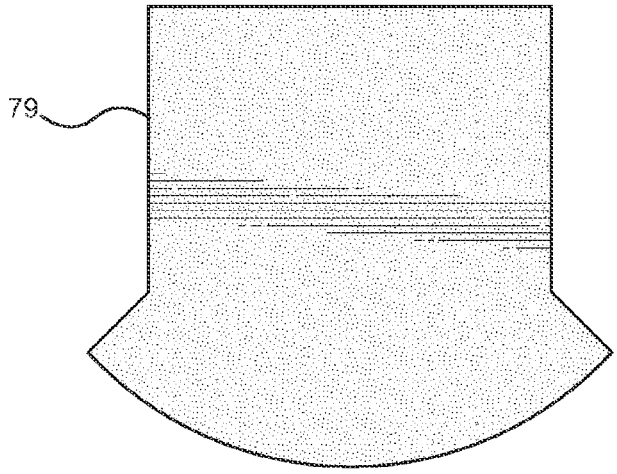
FIG. 6C is a top-down plan view of a muffler made in accordance with an exemplary embodiment of the present invention.
Figure 6D:
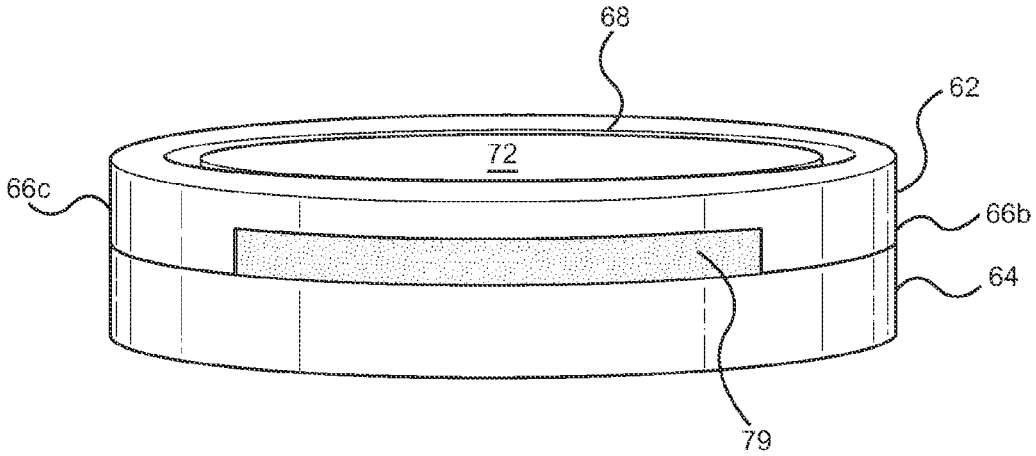
FIG. 6D is a perspective side view of a round percussion device made in accordance with another exemplary embodiment of the present invention.

Platform portion 62 may have an about 5⅞ inch diameter routed central round opening about 7/16 inch deep to define cavity openings 74*a*, 74*b*, 74*c* (see, e.g., FIG. 6D). Smaller cavity openings 74*a* and 74*b* are equal in size and larger cavity opening 74*c* is larger than openings 74*a*, 74*b* (see above). Larger cavity opening 74*c* may be sized to receive muffler 79 illustrated in FIG. 6D. Muffler 79 may be inserted through larger cavity opening 74*c* so as to fit within round cavity 70 defined by the lower surface of round platform portion 62, the inner walls of sidewall portions 66*a*, 66*b*, 66*c*, and the upper surface of round base portion 64. It is noted that four, or more cavity openings may be formed in round drum pad 60, for example, see 16-cavity opening round drum pad 80 illustrated in FIG. 7 and discussed below. In such alternated embodiments, one of the cavity openings may be larger than the other cavity openings, with the larger cavity opening sized to receive muffler 79, or a smaller or larger-sized muffler 79. It is also contemplated to use more than a single muffler sized to fit within a single opening.

Figure 6E:
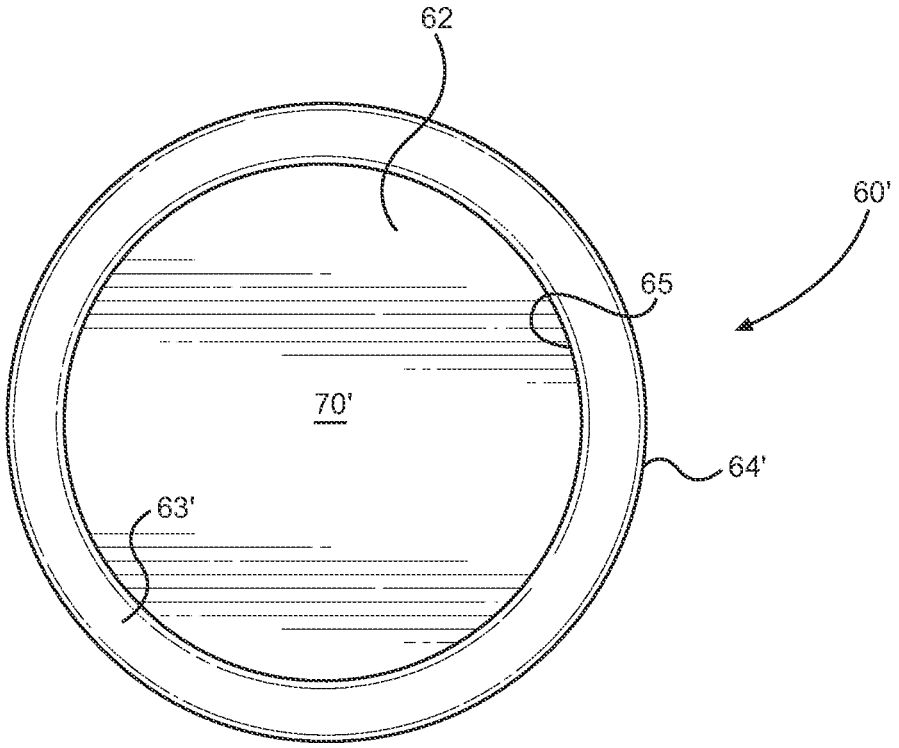
FIG. 6E is a bottom plan view of a round percussion device made in accordance with yet another exemplary embodiment of the present invention.
Figure 6F:
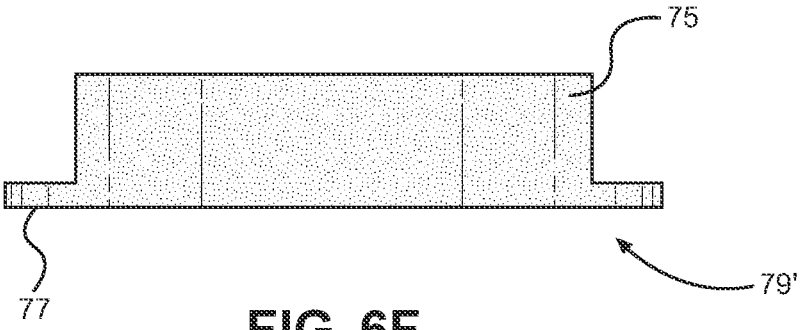
FIG. 6F is a side view of a muffler that is used with the round percussion device illustrated in FIG. 6E made in accordance with another exemplary embodiment of the present invention.

In an alternate embodiment illustrated in FIG. 6E, a bottom-up plan view of drum pad 60' round base portion 62' may be ripped through so that cavity 70' extends from the lower surface of round upper platform portion 62 and through round base portion 62'. Cavity 70' may be a resonating cavity. In this embodiment, as illustrated in FIG. 6F, round muffler 79' may be formed to fit completely within cavity 70' and includes rounded portion 75 with lip 77 extending outwardly from rounded portion 75 at its bottom so that lip 77 extends over bottom surface 63 of ripped round base portion 62'. Round muffler 79' may be sized to snuggly fit with cavity 70'. In this design, muffler 79' completely fills cavity 70'. It is also contemplated that analogous cavities may be formed in rectangular drum pads 10. It is also contemplated that the height of any cavity openings may be sized and positioned in consideration of the increased size of chamber/cavity 70'.

Although not shown, strips of, for example, hook-and-loop material, or non-skid material, may be affixed to the bottom surface of base portion 64 near the edges of base portion 64. An opposing pair of such strips may be affixed to the bottom surface of base portion 64, and a second opposing pair may be used that is 90 degrees from the first pair of strips. These strips permit the reversible mounting of round drum pad 60 to a mounting board as will be discussed below.

Figure 7:
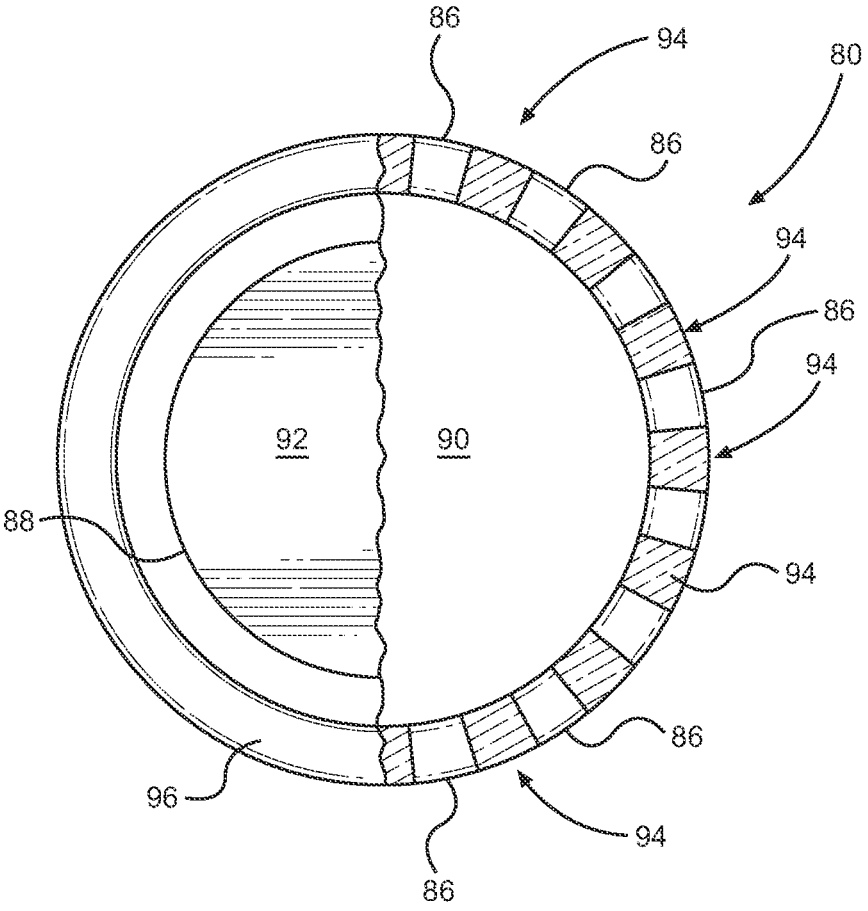
FIG. 7 is a top plan partial cut-away view of a round percussion device made in accordance with an exemplary embodiment of the present invention.

FIG. 7 illustrates round drum pad 80 alternate embodiment having 16 cavity openings 94 equally spaced about the periphery of round drum pad 80, and ripped from upper platform portion 96 to leave 16 sidewall portions 86 that are integral with upper platform portion 96. Upper platform portion 96 and base portion 84 each have a diameter of about 7⅛ inch. Each cavity opening 94 has an arc length of 17/32 inch. Round cavity 90 may be formed within, and centered about, upper platform portion 96 by, for example, routing, with a depth of about 7/16 inch and has a diameter of about 5⅞ inch from the inner surface of sidewall portion 89 to the inner surface of opposing sidewall portion. Round cavity 90 may be a resonating cavity. Round striking portion 88 may be centered over the upper surface of upper platform portion 96, and may be placed with a routed depression formed in platform portion 82. Striking portion 88 has a diameter of about 5⅞ inch. A side-inserted muffler(s) is/are not generally used with round drum pad 80. But if the lower surface of lower round base portion is ripped out so that the cavity now extends through the bottom of round drum pad 80', then a muffler analogous to muffler 79' may be used to muffler round drum pad 80'.

It is noted, and readily apparent from the above disclosure, drum pads made in accordance with the present invention may be more compact than traditional drum pads having separated upper and lower portions that results in a reduction in the amount of materials needed, reduced manufacturing costs and shipping costs. As such, the thickness of the lower base portion may approximately equal the sum of the thickness of the upper platform portion plus the thickness of the sidewall(s)/height of the cavity opening(s) (or in the case of the round percussion devices, the cavity opening(s) which are formed from a portion of the upper platform portion. It is also contemplated that the thickness of the lower base portion may be greater than the sum of the thickness of the upper platform portion plus the thickness of the sidewall(s)/height of the cavity opening(s) (or in the case of the round percussion devices, the cavity opening(s) which are formed from a portion of the upper platform portion. For a given material from which the percussion device is formed, the thicknesses of the lower base portion and upper platform portion may remain essentially constant while the size of the cavity/chamber, and/or the height of the cavity openings, is/are altered to obtain a desired pitch of the percussion device while played.

Figure 8:
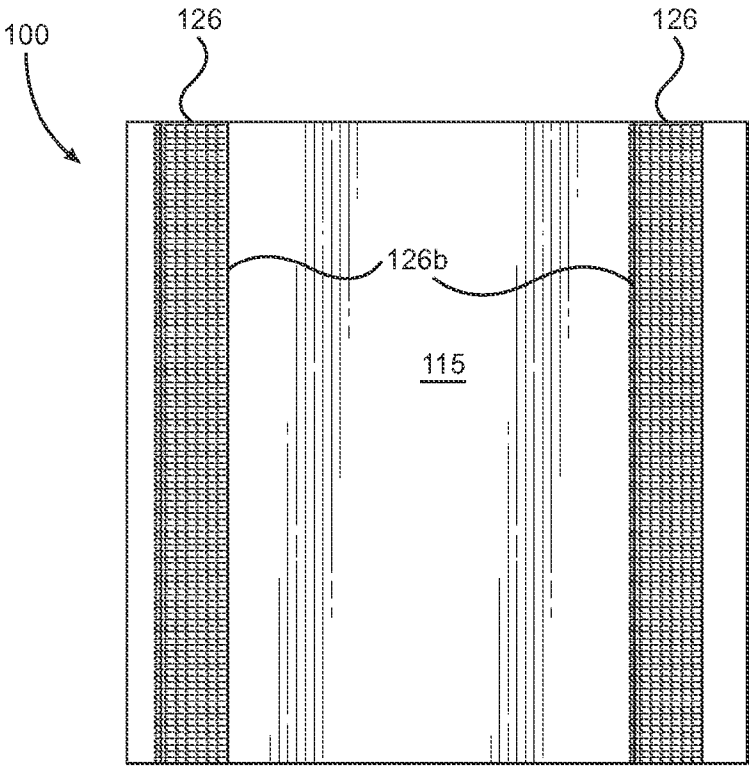
FIG. 8 is a top plan view of a single-mounting board for use with a percussion device in use in accordance with an exemplary embodiment of the present invention.

FIG. 8 illustrates single-mounting board 100 for mounting/securing, preferably, a single percussion device 10, 60, 80 in accordance with an exemplary embodiment of the present invention. Single-mounting board 100 includes mounting strips 126 placed on upper surface 115 so as to mate with corresponding mounting strips on a percussion device/pad. Mounting strips 126 may be, for example, hook-side strips 126*b* that are spaced, sized, and oriented so as to mate with, for example, loop-side strips 26*a* of rectangular drum pad 10 illustrated in FIGS. 1A-1C and 2-5, and/or loop-side strips (not shown) of round drum pads 60, 80 illustrated in FIGS. 6A-6B and 7. In use, rectangular drum pad 10 (or round drum pad 60, 80) may be placed over single-mounting board 100 so that corresponding hook-and-loop strips 126*b*, 26*a* are generally opposite one another, and rectangular drum pad 10 may be pressed upon single-mounting board 100 so as to reversibly mate hook-and-loop strips 26*a*, 126*b* to secure rectangular drum pad 10 to single-mounting board 100. Round drum pad 60, 80 may be oriented in a manner to secure opposing loop-side strips to a portion of hook-side strips 126*a*.

Figure 9:
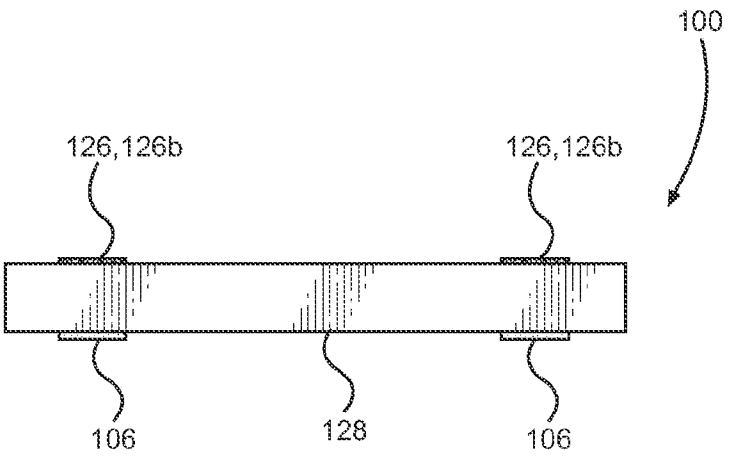
FIG. 9 is a side view of the single-mounting board of FIG. 8 in accordance with an exemplary embodiment of the present invention.

FIG. 9 is a side view of single-mounting board 100 illustrated in FIG. 8. Lower surface 128 of single-mounting board 100 includes non-skid, or the like, strips 106 mounted so as to tend to prevent single-mounting board 100 from sliding or scratching a surface upon which it is placed. Strips/hook-side strips 126, 126*a* are shown on the upper side of single-mounting board 100, and positioned generally opposite non-skid strips 106, although this not be in all applications.

Figure 10:
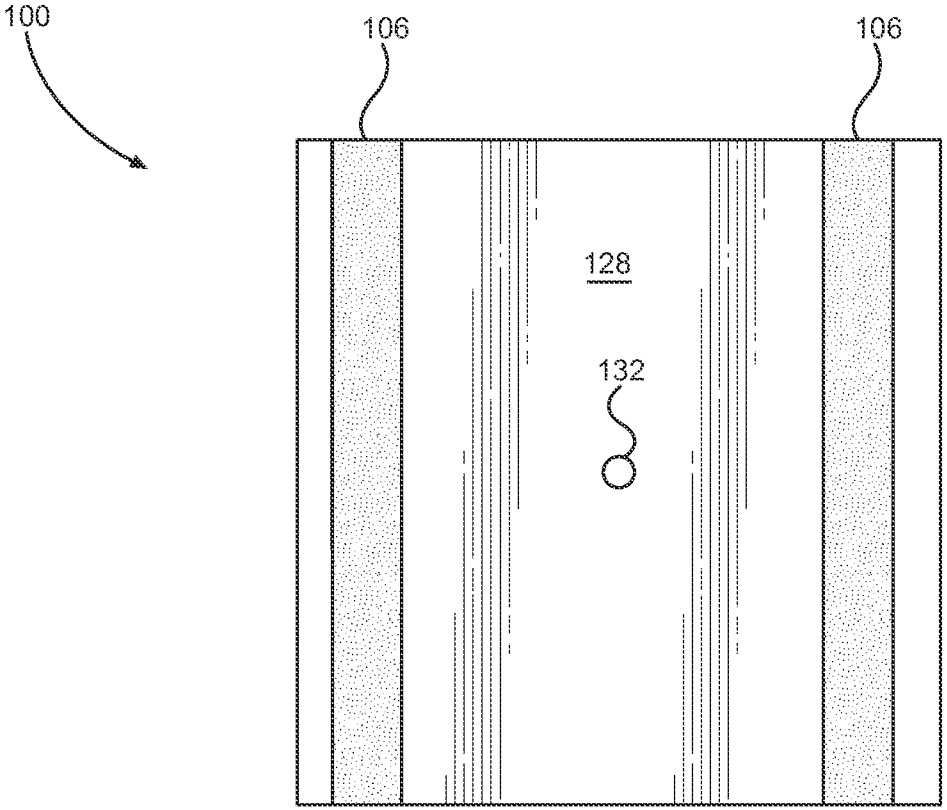
FIG. 10 is a bottom plan view the single-mounting board of FIG. 8 in accordance with an exemplary embodiment of the present invention.

FIG. 10 is a plan view of the bottom of single-mounting board 100 illustrated in FIGS. 8-9. Non-skid, or the like, strips 106 may be affixed to lower surface 128 so as to tend to prevent single-mounting board 100 from sliding or scratching a surface upon which it may be placed. As shown, non-skid strips 106 may be mounted in parallel and may be generally opposite hook-side material strips 126*b* on upper surface 115 (as noted above). Threaded female opening 132 (e.g., see FIG. 10) may be formed at the center of lower surface 128 to permit mounting of single-mounting board 100 to a stand or the like. A mating male threaded rod may be placed within threaded female opening 132 and single-mounting board 100 may be rotated to engage and retain the mail threaded rod within threaded female opening 32 (e.g., a standard size 8 mm threaded female opening) and single-mounting board 100 to the stand or the like. By mounting drum pad 10, 60, 80 onto mounting board 100 which may be in turn mounted to a stand using the female threaded opening, the sound/pitch quality of drum pad 10 may be faithfully produced during practice or performance.

Figure 11:
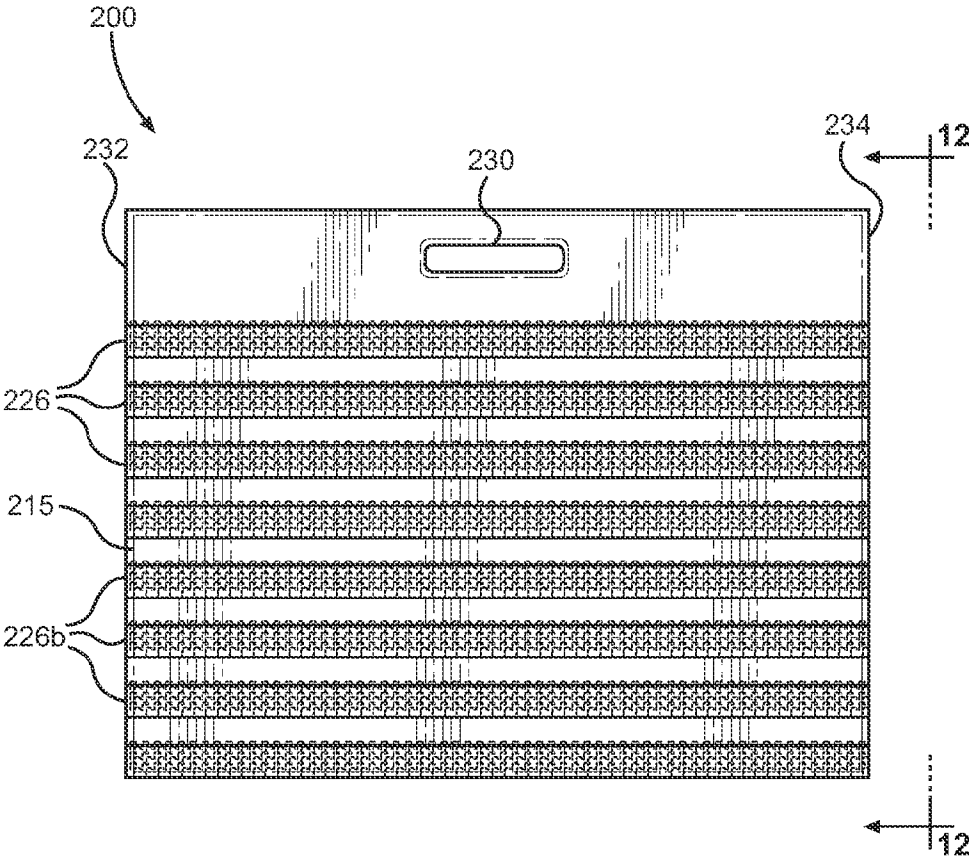
FIG. 11 is a top plan view of a multiple-mounting board for use with one or more percussion devices in use in accordance with another exemplary embodiment of the present invention.

FIG. 11 illustrates multiple-mounting board 200 for mounting/securing one or more percussion devices 10, 60, 80 in accordance with an exemplary embodiment of the present invention. Multiple-mounting board 100 may include multiple mounting strips 226 placed on upper surface 215 so as to mate with corresponding mounting strips on a percussion device/pad. Mounting strips 226 may be, for example, hook-side strips 226*b* that are spaced, sized, and oriented in parallel so as to mate with, for example, loop-side strips 26*a* of one or more rectangular drum pads 10 illustrated in FIGS. 1A-1C and 2-5, and/or loop-side strips (not shown) of round drum pads 60, 80 illustrated in FIGS. 6A-6B and 7. In use, rectangular drum pad 10 may be placed over a selected portion of multiple-mounting board 100 so that corresponding hook-and-loop strips 226*b*, 26*a* are generally opposite one another, and drum pad 10 may be pressed upon multiple-mounting board 200 so as to reversibly mate hook-and-loop strips 226*b*, 26*a* to secure rectangular drum pad 10 to a portion of multiple-mounting board 200. Other rectangular or round drum pads 10, 60, 80 may be mounted to multiple-mounting board 200 in similar fashion in a pattern as desired to facilitate practice (with or without muffler pads within the respective chambers/cavities) or performance (generally without muffler pads). Multiple-mounting board 200 includes a handle 230 for movement and positioning of multiple-mounting board 200. It is noted that the design of the mufflers used in accordance with the teachings of the present invention may be easily inserted and removed from drum pads 10, 60, 80 while mounted on single-mounting boards 100 or multiple-mounting boards 200 as long as drum pads 10, 60, 80 are mounted with the openings of their respective cavities are accessible. Even for drum pads 60', they may be easily removed from mounting boards 100, 200, have their muffler 79' inserted, or removed, and quickly remounted on mounting boards 100, 200.

Figure 12:
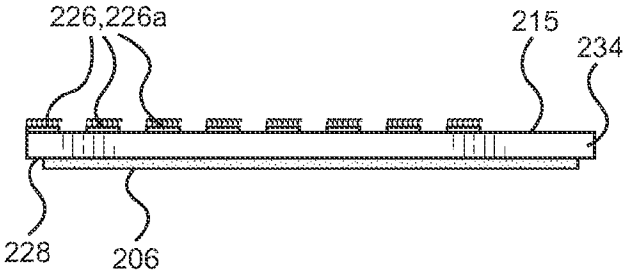
FIG. 12 is a side view of the multiple-mounting board of FIG. 11 taken along line 12-12 of FIG. 11 in accordance with an exemplary embodiment of the present invention.

FIG. 12 is a side view of multiple-mounting board 200 illustrated in FIG. 11 when viewed along line 12-12. Lower surface 228 of multiple-mounting board 200 includes non-skid, or the like, pad 206 mounted so as to tend to prevent multiple-mounting board 200 from sliding or scratching a surface upon which it may be placed. As illustrated non-skid pad 206 extends from proximate one side 232 to proximate opposing side 234 of multiple-mounting board 200, and opposes most of hook so as to prevent skidding on, or scratching, a surface upon which it may be placed.

Figure 13:
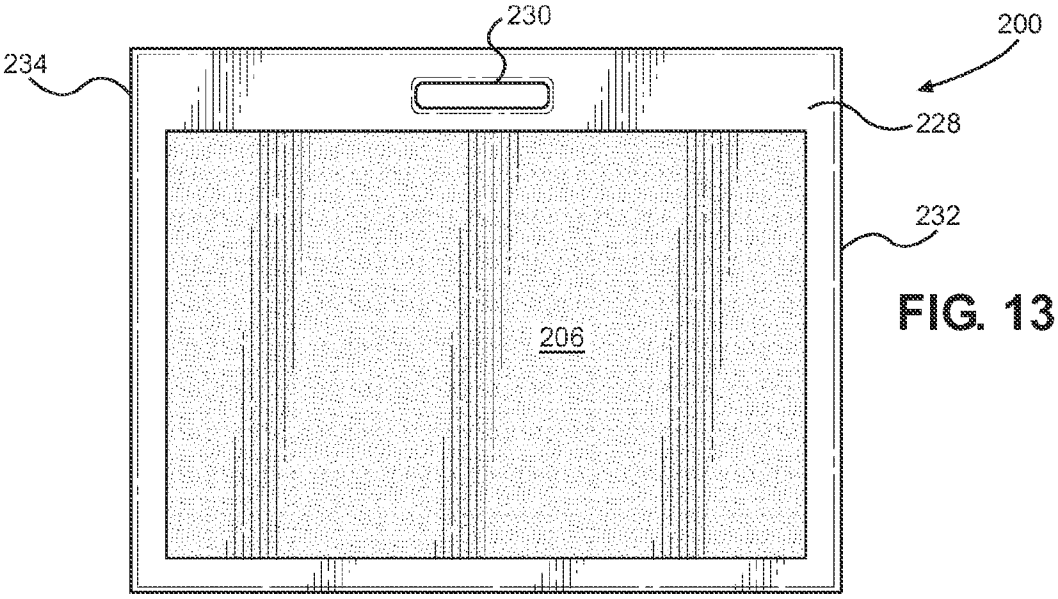
FIG. 13 is a bottom plan view of the multiple-mounting board of FIG. 11 in accordance with an exemplary embodiment of the present invention.

FIG. 13 is a plan view of the bottom of multiple-mounting board 100 illustrated in FIG. 11 taken along line 12-12. Non-skid, or the like, pad 206 may be affixed to lower surface 228 so as to tend to prevent multiple-mounting board 200 from sliding or scratching a surface upon which it may be placed. As shown, non-skid pad 206 may be mounted to generally oppose the placement of hook-side material strips 226*b* on upper surface 215. Due to the size of multiple-mounting board 200, a threaded female opening is generally not used to mount multiple-mounting board 200 to a stand or the like although varying mounting structures are contemplated.

Figure 14:
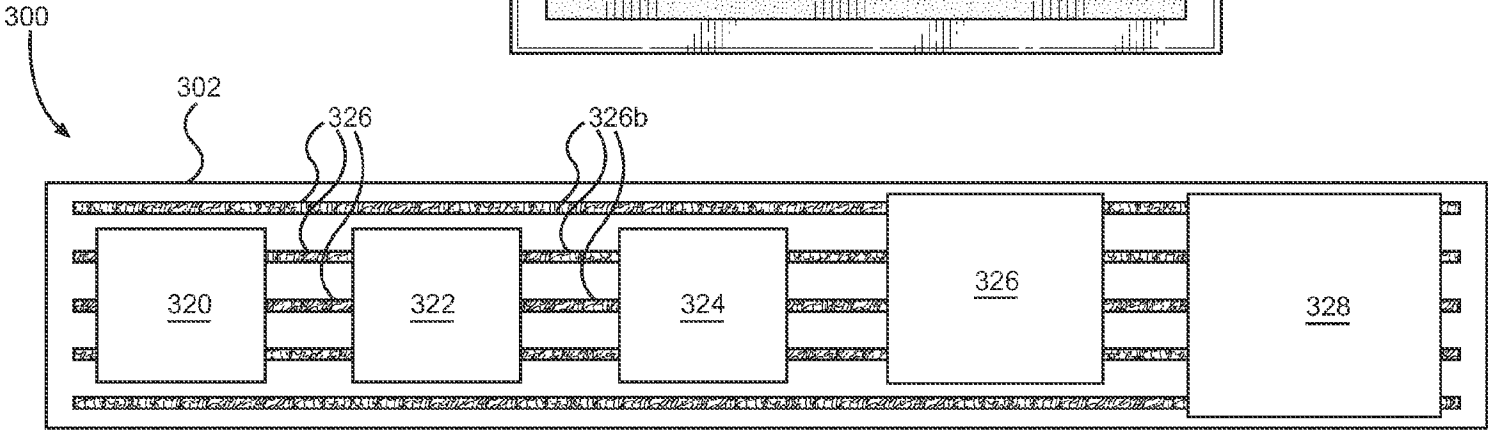
FIG. 14 is a top down plan view of a multiple-mounting board with various drum pads mounted thereto in in accordance with another exemplary embodiment of the present invention.

FIG. 14 is a top down plan view of multiple-mounting board 300 made in accordance with an exemplary embodiment of the present invention. Multiple-mounting board 300 may include rows of mounting strips 326 which may be hook-side material mounting strips 326*b*. One or more drum pads 320, 322, 324, 326, 328 may be mounted on mounting board 300 in accordance with the teachings of the present invention and arranged in a manner suitable for practice and/or performance. For example, drum pads 320, 322, 324, 326, 328 having varying pitches (e.g., harmonizing pitches) may be arranged from highest pitch (e.g., drum pad 320) on the left side as a user would face with decreasing pitch towards the lowest pitch drum pad 328. Multiple-mounting board 300 could be oriented so the lowest pitch drum pad 328 was on the furthest left of a user, and the highest pitch drum pad 320 on the furthest right of a user, or in any other configuration as desired. Drum pads 320, 322, 324, 326, 328 may also be arranged in a manner similar to a traditional drum set as one of ordinary skill in the art would understand, or in another arrangement as desired for a given purpose.

The sound of drum pads 10, 60, 80; 60' may be of high enough quality and may be used for public performances in addition to private practice. When used as a practice pad removable muffler pad 30, 79', respectively, adds the option of much lower volume. When muffler pad 30; 79' is placed within the respective cavities, the noise reduction when drum pads 10, 60, 80; 60', respectively, is struck may be significant.

As described herein, but not limited thereto, the present invention is a variable pitch practice pad used for either drum practice or live performance. The pad may be constructed of hard material, includes a chamber and creates a specific pitch when played. The striking surface may be comprised of a resilient material that closely imitates the playing surface and rebound of a real drum. There is a removable mounting system that allows stand alone application or use by mounting to a stand. When used with mounting system it may become an important piece of a drum set. When not used with the mounting stand the non-skid material on the bottom tends to prevent the pad from sliding or scratching a surface upon which it may be placed. While specific embodiments have been illustrated, the invention is not so limited. Various alterations, such as size and shape are contemplated. The drum pad made in accordance with the teachings of the present invention may be constructed using various durable materials, of varying thicknesses, color choices, densities, chamber sizes or profiles.

While particular embodiments of the present invention have been illustrated and described, it is not intended to limit the invention, except as defined by the following claims.

I claim:

1. A percussion device comprised of:

a platform portion composed of a first material having an exposed striking portion composed of a second material;

a base portion separated from, and substantially parallel to, the platform portion by a predetermined distance;

at least one unitary sidewall portion positioned between the platform portion and the base portion at respective opposing edges of the platform portion; and a second unitary sidewall portion joining the platform portion and the base portion at second respective opposing edges of the platform portion and the base portion.

2. The percussion device of claim 1 wherein the base portion and the at least one unitary sidewall portion are each composed of the first material.

3. The percussion device of claim 1 wherein the platform portion, the base portion and the at least one unitary sidewall portion together form a unitary percussion device structure.

4. The percussion device of claim 1 further comprising at least one attachment structure on an exposed surface of the base portion.

5. The percussion device of claim 1 wherein the striking portion is within a depression formed within a surface of the platform portion.

6. The percussion device of claim 1 wherein the percussion device is substantially rectangular-shaped.

7. The percussion device of claim 1 wherein the percussion device is substantially round-shaped.

8. The percussion device of claim 1 wherein the percussion device is sized such that striking an exposed surface of the exposed striking portion with a striking device creates a sound of a predetermined pitch.

9. The percussion device of claim 1 wherein the second material is different than the first material.

10. The percussion device of claim 1 further comprising an insert portion comprised of a third material sized to reversibly fit at least partially within a space defined by (a) the striking portion, (b) the base portion and (c) the at least one unitary sidewall portion.

11. The percussion device of claim 4 wherein the percussion device is reversibly affixed to an obverse side of a mounting structure using the at least one attachment structure on the exposed surface of the base portion and an opposing attachment structure on an obverse side of the mounting structure.

12. The percussion device of claim 11 wherein the attachment structures on the base portion is one of a hook attachment structure and a loop attachment structure, and the attachment structures on the mounting structure is another of the hook attachment structure and the loop attachment structure.

13. The percussion device of claim 11 wherein the mounting structure includes a threaded opening on a reverse side, the threaded opening substantially being at the center of the reverse side.

14. The percussion device of claim 1 wherein the striking portion is composed of a resilient material.

15. The percussion device of claim 1 wherein the platform portion, the base portion and the at least one unitary sidewall portion are each comprised of wood or plastic, the striking portion is comprised of natural gum rubber, a synthetic rubber or silicone.

16. A percussion device comprised of:

a platform portion composed of a first material having an exposed striking portion composed of a second material on an obverse side of the platform portion;

a base portion separated from, and substantially parallel to, the platform portion by a predetermined distance;

at least one unitary sidewall portion positioned between the platform portion and the base portion at respective opposing edges of the platform portion and the base portion; and a generally central cavity formed through the base portion and into the platform portion.

17. The percussion device of claim 16 further comprising a muffler sized to fit within the generally central cavity.

18. The percussion device of claim 17 wherein the muffler includes an outwardly extending lip about the periphery of an end of the muffler exposed when the muffler is within the generally central cavity, the lip contacting an exposed lower surface of the base portion.

19. A percussion device comprising:

(1) an upper platform portion comprised of a first material including a striking portion comprised of a second material different from the first material;

(2) a lower base portion comprised of the first material;

(3) at least one unitary sidewall portion comprised of the first material, positioned between the upper platform portion and the lower base portion along opposing edges of the upper platform portion and the lower base portion;

(4) a resonating cavity within the percussion device defined by at least (a) a lower surface of the upper platform portion, (b) interior sidewalls of the at least one unitary sidewall portion, and (c) a portion of the lower base portion; and (5) at least one cavity opening formed through a portion of the at least one unitary sidewall portion, the at least one opening communicating with the resonating cavity.

* * * * *